US005950269A

United States Patent [19]

Openshaw et al.

[11] Patent Number: 5,950,269

[45] Date of Patent: Sep. 14, 1999

[54] BOOT AND SHOE SOLE CLEANER

[76] Inventors: Deryl E. Openshaw; Jim E. Openshaw, both of 7046 Church Rd., Shepherd, Mont. 59079

[21] Appl. No.: 08/938,364

[22] Filed: Sep. 26, 1997

Related U.S. Application Data

[60] Provisional application No. 60/026,809, Sep. 27, 1996.

[51] Int. Cl.[6] ..... A46B 11/04

[52] U.S. Cl. ..... 15/36; 15/34

[58] Field of Search ..... 15/30, 32, 34, 15/36

[56] References Cited

U.S. PATENT DOCUMENTS

| | | | |
|---|---|---|---|
| 826,806 | 7/1906 | Scoggins . | |
| 1,277,834 | 9/1918 | Berdar | 15/36 |
| 1,567,832 | 12/1925 | Broge . | |
| 2,718,020 | 9/1955 | Homme . | |
| 2,958,883 | 11/1960 | Walters . | |
| 3,048,867 | 8/1962 | Counts | 15/36 |
| 3,228,052 | 1/1966 | Kuz | 15/36 |
| 3,231,916 | 2/1966 | Melenfant . | |
| 3,641,609 | 2/1972 | Hansen . | |
| 3,802,021 | 4/1974 | Schulz | 15/36 |
| 4,014,060 | 3/1977 | Taylor . | |
| 4,024,599 | 5/1977 | Gamboa . | |
| 4,233,707 | 11/1980 | Leblanc . | |

*Primary Examiner*—Terrence R. Till
*Attorney, Agent, or Firm*—Richard C. Conover

[57] ABSTRACT

A sole cleaning device for cleaning the bottoms and sides of the soles of boots and shoes including a rotating brush mounted above a container of water so that upon rotation of the brush a portion of the brush extends into the water. The device further including a removable scraper grate for supporting a shoe above the water but in engagement with the brush. A motor for rotating the brush against the sole of the boot. The removable grate provided with a pair of spaced and parallel side rails having fixed brushes mounted to the side rails and facing one another. The removable grate further including a sieve platform extending on one side of the grate above the water. Sponges are positioned on top of the sieve for removing water from a boot or shoe placed on the sponge.

5 Claims, 3 Drawing Sheets

BOOT AND SHOE SOLE CLEANER

This application claims priority under 35 U.S.C. 119(e) of provisional application 60/026,809, filed Sep. 27, 1996.

BACKGROUND

This application relates to a device for cleaning the bottom and sides of a boot or shoe sole.

Boot cleaners are known that use a brush immersed in water for a part of the brush's rotation. For example, see U.S. Pat. No. 826,806 to Scoggins and U.S. Pat. No. 2,958,883 to Walters.

Other known cleaner devices use a brush alone, or a brush and an air stream or a brush and scrapers such as shown in U.S. Pat. No. 1,567,832 to Broge, U.S. Pat. No. 4,014,060 to Taylor, U.S. Pat. No. 4,024,599 to Gamboa, and U.S. Pat. No. 4,233,707 to Leblanc.

SUMMARY OF INVENTION

The present invention relates to a sole cleaning device for cleaning the bottoms and sides of the soles of boots and shoes. A rotating brush is mounted above a container of water so that upon rotation of the brush, a portion of the brush extends into the water. The rotating brush is in turn mounted to a motor controlled by a step-on switch for rotating the brush. The rotating brush is mounted in a housing which also includes a removable platform for supporting a shoe above the water but in engagement with the brush. A pair of spaced apart and parallel side rails are mounted to the removable platform in a perpendicular relation to the axis of rotation of the brush. Fixed brushes are mounted to the side rails in facing relation.

The removable platform further includes a series of spaced apart scraper elements secured between the siderails. The scraper elements together form a grate for supporting a boot or shoe when the boot or shoe is being cleaned. The grate is positioned above the rotating brush and between the two side cleaning brushes. The housing also includes a sieve platform extending on one side of the removable platform above the water. Sponges are positioned upon top of the sieve.

When a shoe or boot is being cleaned, the user steps on the step switch to start the rotating brush and places his shoe on the grate. The rotating brush cleans the bottom of the sole and by moving the shoe back and forth against the side brushes the sides of the sole can be cleaned. Next, the user places his boot or shoe on the sponges to absorb any excess water on the sole. By stepping on the sponges, water is squeezed out of the sponge, through the sieve and back into the water container.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
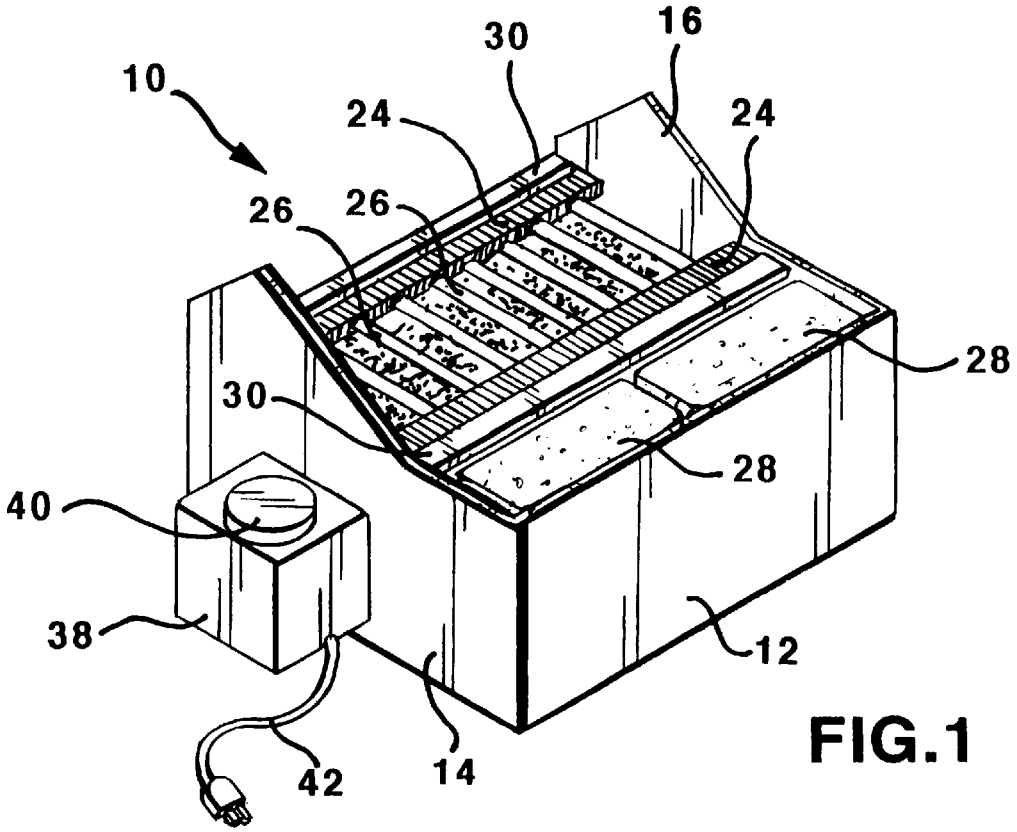
FIG. 1 is a perspective view of a sole cleaner according to the present invention.
Figure 2:
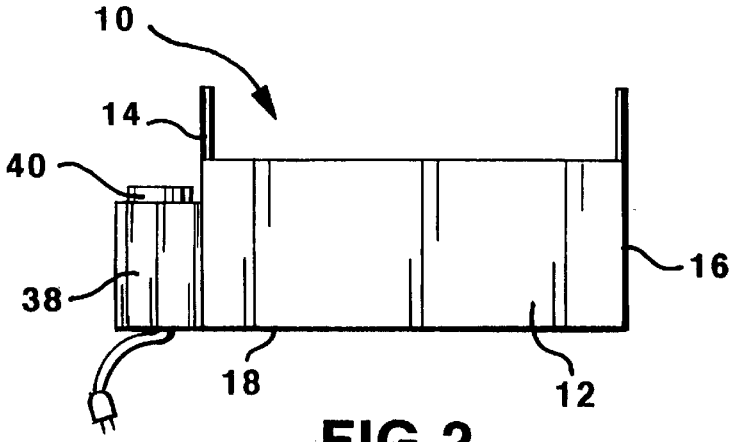
FIG. 2 is a front elevational view of the sole cleaner shown in FIG. 1.
Figure 3:
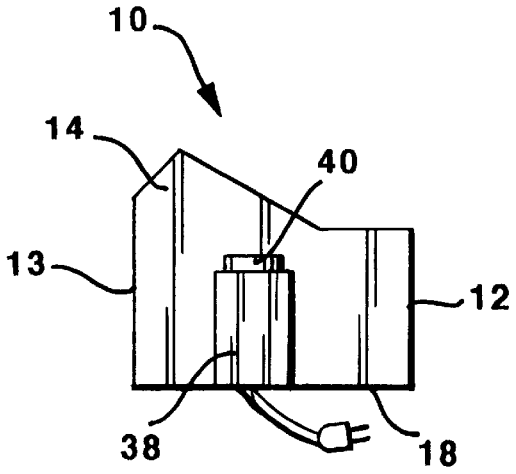
FIG. 3 is a left side view of the sole cleaner shown in FIG. 2.
Figure 4:
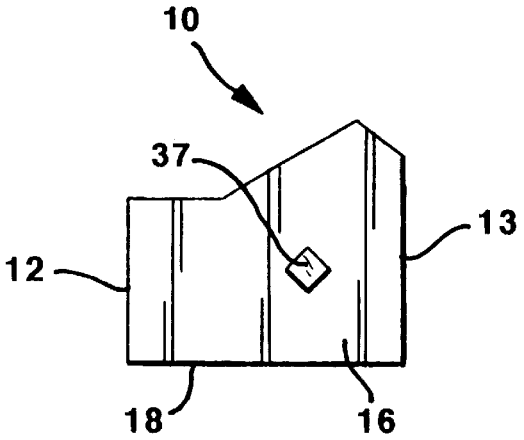
FIG. 4 is a right side view of the sole cleaner shown in FIG. 2.
Figure 6:
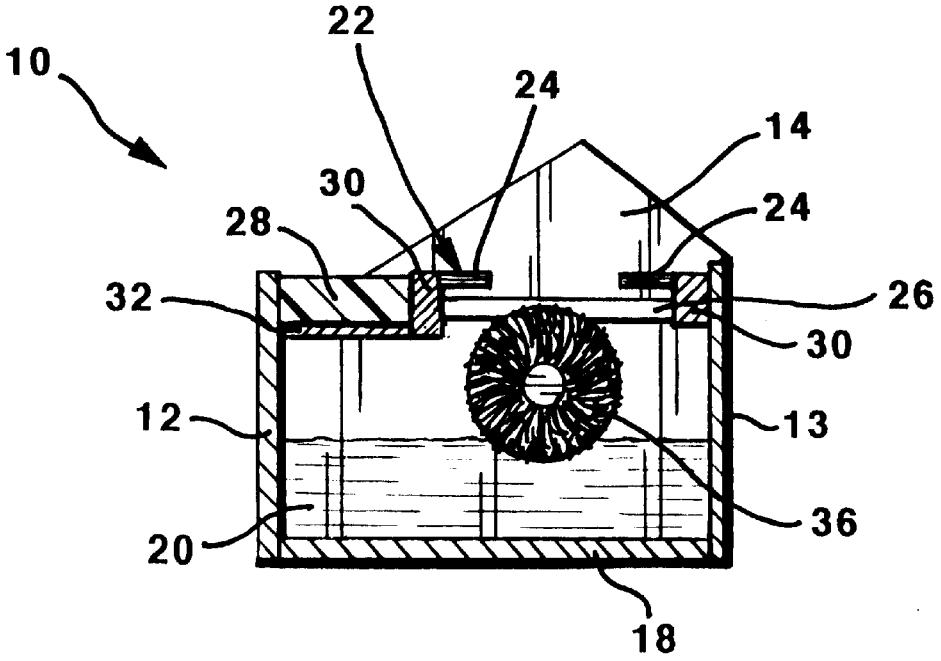
FIG. 6 is a cross-sectional view of the sole cleaner taken along the line 6—6 in FIG. 5.

A sole cleaner 10 according to the present invention is shown in FIG. 1. Sole cleaner 10 includes a housing having a front wall 12, a back wall 13, a left sidewall 14, a right sidewall 16 and a bottom wall 18 as shown in FIGS. 2, 3 and 4. All of these walls and bottom 18 are connected together to form a watertight container that will hold water 20 as best seen in FIG. 6. Left sidewall 14 and right sidewall 16 each have a shaped upper portion as seen in FIGS. 3 and 4 which function as splash guards.

Figure 7:
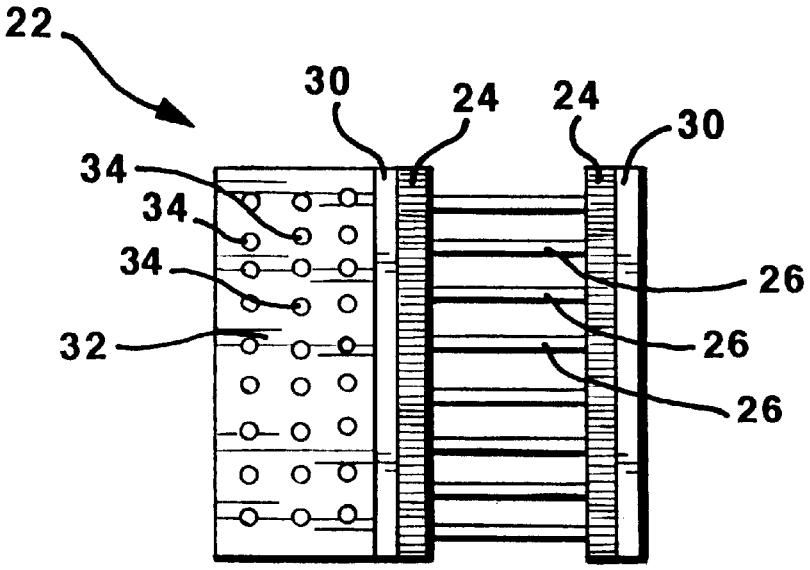
FIG. 7 is a top plan view of a detachable, cleaning unit shown in FIG. 5 and 6.

A removable platform 22, as shown in FIG. 7, is held within the housing of device 10 spaced apart from bottom 18 and above water 20 as shown in FIG. 6 in a conventional manner. Platform 27 includes a pair of parallel siderails 30 extending from one side to the other of the cleaning unit as best seen in FIG. 7.

A brush 24 is secured to each siderail 30 as shown in FIGS. 6 and 7. Multiple scrapers 26, as shown in FIGS. 6 and 7, are secured to and between siderails 30 in spaced apart and parallel relation and are positioned below brushes 24 as best seen in FIG. 6.

Figure 5:
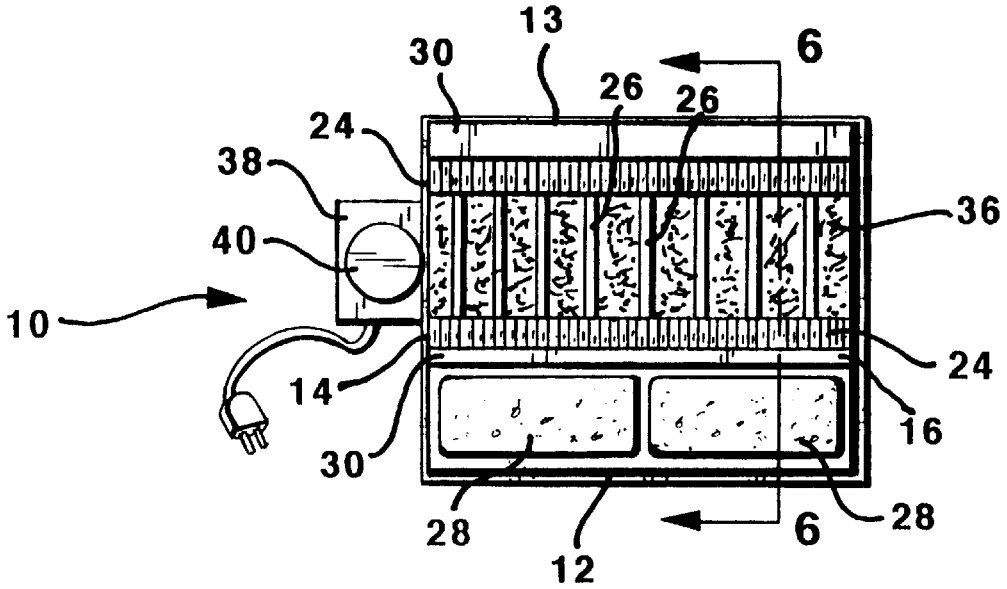
FIG. 5 is a top plan view of the sole cleaner shown in FIG. 2.

The scrapers together form a grate for supporting a boot while it is being cleaned. The removable platform further includes a sieve 32 which is attached to one siderail 30 and extends laterally away from siderail 30 as best seen in FIGS. 6 and 7 above water 20. Sponges 28 are placed on sieve 32 as best seen in FIGS. 1 and 5. Holes 34 in sieve 32 permit water 20 to drop through the holes back into the water 20 contained within sole cleaner 10.

A cylindrical brush 36 is rotatably mounted between left and right sidewalls 14 and 16 as best seen in FIGS. 5 and 6. Brush 36 has one end connected to a conventional motor unit 38. A step-on switch 40 is used to start motor 38 to rotate brush 36. The other end of brush 36 is held in a bearing 37 as shown in FIG. 4. The motor unit 38 is connected to an outlet through cord 42.

The soft bristles of circular brush 36 extend upward between scrapers 26 as best seen in FIG. 6 whenever circular brush 36 is rotated so as to brush against a shoe sole that is positioned on the scrapers.

In operation, sole cleaner 10 is partially filled with water 20 so that the lower portion of circular brush 36 rests within the water. Cord 42 is also plugged into a convenient electrical outlet.

A person wanting his shoes cleaned, steps on the step-on switch 40 to start circular brush 36 rotating. He then places the sole of his shoe upon the grate formed by scrapers 26. Brushes 24 extend towards the sides of the sole, and as the user moves his shoe approximately perpendicular to the scrapers to remove large chunks of mud, brushes 24 will brush off mud on the sides of the sole during this movement. Rotating circular brush 36 brushes against the bottom of the sole while the shoe rests on scrapers 26 to clean mud caught in the treads of the sole. The brush rotates through water 20 which cleans the brush before again brushing against the sole.

When the person determines the sole is clean, he can remove his shoe from scrapers 26. He can then place the sole upon sponges 28 to pat or rub his sole as dry as the sponges allow. Excess water from this step will drain from sponges 28, pass through holes 34 and return to the well of water 20 that lies in the bottom of sole cleaner 10.

When the person is finished with both shoes, he can turn off the rotation of circular brush 36 by stepping again on step-on switch 40 to turn off motor unit 38.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

We claim:

1. A boot and sole cleaning device comprising:

a watertight housing for holding a reservoir of water, the housing having a top;

a removable cleaning platform, which rests within the housing adjacent the top above the water, the platform including a pair of spaced apart and parallel siderails;

a plurality of scrapers extending between and secured to the siderails in a spaced apart and parallel relation;

a cylindrical brush mounted in the housing with a lower portion of the brush resting within the water and an upper portion extending above and between the scrapers;

an electrical motor connected to the brush so as to rotate the brush.

2. The boot and sole cleaning device of claim 1 further including a step-on switch for activating the motor.

3. The boot and sole cleaning device of claim 1 further including a pair of facing brushes with each brush being attached to a corresponding siderail.

4. The boot and sole cleaning device of claim 1 wherein the removable platform further includes a sieve connected to and extending laterally away from a siderail in a direction away from the scrapers, the sieve having holes to permit water to drop into the reservoir of water.

5. The boot and sole cleaning device of claim 4 further including a sponge sized to fit on the top of the sieve.

* * * * *